US010119380B2

(12) United States Patent
Joseph et al.

(10) Patent No.: US 10,119,380 B2
(45) Date of Patent: Nov. 6, 2018

(54) CENTRALIZED ARTICULATING POWER SYSTEM

(71) Applicant: Schlumberger Technology Corporation, Sugar Land, TX (US)

(72) Inventors: Jijo Oommen Joseph, Houston, TX (US); Olivier Clerc, Houston, TX (US); Kim Hodgson, Sugar Land, TX (US); David James Bagnall, Sugar Land, TX (US); Steven Schilling, Sealy, TX (US); Willem Hengeveld, Vecta (DE)

(73) Assignee: Schlumberger Technology Corporation, Sugar Land, TX (US)

( * ) Notice: Subject to any disclaimer, the term of this patent is extended or adjusted under 35 U.S.C. 154(b) by 218 days.

(21) Appl. No.: 14/853,037

(22) Filed: Sep. 14, 2015

(65) Prior Publication Data

US 2017/0074074 A1 Mar. 16, 2017

(51) Int. Cl.
*H02J 3/14* (2006.01)
*E21B 43/26* (2006.01)

(52) U.S. Cl.
CPC ..... *E21B 43/26* (2013.01)

(58) Field of Classification Search
CPC ..... E21B 43/26
USPC ..... 307/31
See application file for complete search history.

(56) References Cited

U.S. PATENT DOCUMENTS

2005/0076965 A1* 4/2005 Buckner ..... B60P 3/2245 137/899.4
2009/0194273 A1* 8/2009 Surjaatmadja ..... E21B 43/26 166/250.1

* cited by examiner

*Primary Examiner* — Thomas Skibinski
(74) *Attorney, Agent, or Firm* — Michael L. Flynn; Rachel E. Greene; Robin Nava

(57) ABSTRACT

A centralized power system including at least one engine having a plurality of discharge connectors; a plurality of articulating power connectors, each articulating power connector comprising a first end connected to a corresponding discharge connector, and a second end connectable to at least one piece of oilfield equipment thereby supplying power from the at least one engine to the oilfield equipment.

20 Claims, 8 Drawing Sheets

CENTRALIZED ARTICULATING POWER SYSTEM

BACKGROUND

Various oilfield operations which produce petroleum products from underground formations require power to operate equipment. Some equipment used at a wellsite in oilfield services, including fracturing operations, may be brought to the site via trailers, trucks and skids. The trailers and skids may be brought to the site by tractors. Tractors are generally used to haul equipment used in oilfield operations (such as pumps and blenders) to various field locations. The tractors may also be used to supply power to the equipment.

Power in oilfield operations may be supplied to pumps and blenders, such as those used in hydraulic fracturing, auxiliary equipment, winterization equipment, liquid transport trailers, sand feeders, and gas operated relief valves (GORV).

A centralized power unit may supply power to hydraulic fracturing operations. Hydraulic fracturing is among the varied oilfield operations used to produce petroleum products from underground formations. In hydraulic fracturing, a fluid is pumped down a wellbore at a flow rate and pressure sufficient to fracture a subterranean formation. After the fracture is created or, optionally, in conjunction with the creation of the fracture, proppants may be injected into the wellbore and into the fracture. The proppant is a particulate material added to the pumped fluid to produce a slurry. The proppant within the fracturing fluid forms a proppant pack to prevent the fracture from closing when pressure is released, providing improved flow of recoverable fluids, i.e. oil, gas, or water.

SUMMARY

Embodiments disclosed provide a centralized power system including at least one engine having a plurality of discharge connectors, a plurality of articulating power connectors, each articulating power connector comprising a first end connected to a corresponding discharge connector, and a second end connectable to at least one piece of oilfield equipment thereby supplying power from the at least one engine to the oilfield equipment.

Embodiments disclosed also provide a method of starting at least one piece of wellbore fluid service equipment including the steps of coupling a centralized power engine for supplying power to a plurality of equipment and supplying power to the plurality of equipment from the centralized power engine.

Figure 1:
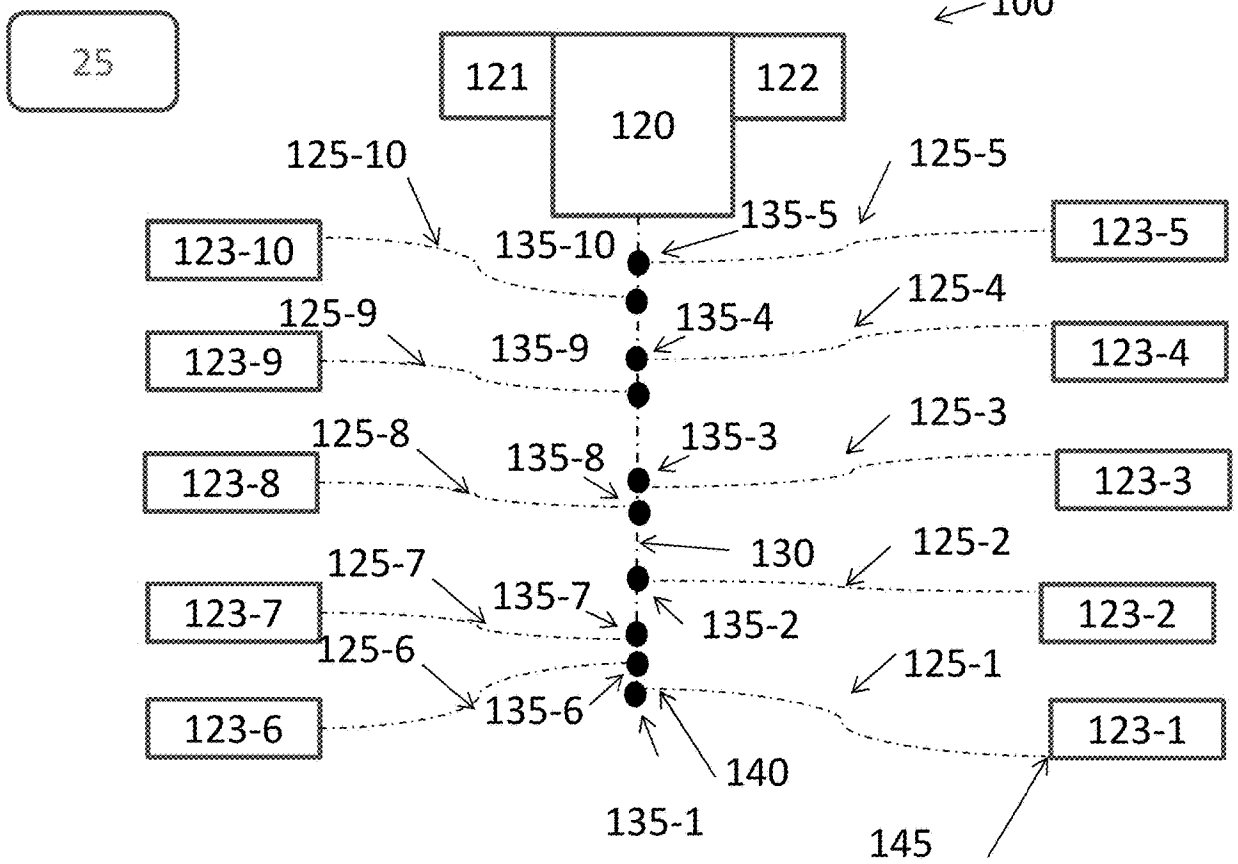
FIG. 1 illustrates a block diagram of a centralized power system, according to an embodiment.

It should be noted that some details of the figures have been simplified and are drawn to facilitate understanding of the embodiments rather than to maintain strict structural accuracy, detail and scale.

DETAILED DESCRIPTION

Reference will now be made in detail to embodiments of the present disclosure, examples of which are illustrated in the accompanying drawings. In the drawings and the following description, like reference numerals are used to designate like elements, where convenient. It will be appreciated that the following description is not intended to exhaustively show all examples, but is merely exemplary.

Embodiments of the present disclosure generally relate to providing a centralized power system for supplying power to multiple engines used to power multiple pieces of equipment at a wellsite in an oilfield operation. Also provided are embodiments of a method for operating the centralized power system for supplying power to multiple engines used to power multiple pieces of equipment.

Referring now to the figures, shown in FIG. 1 is an example of a centralized power system 100. In some embodiments, the centralized power system 100 includes a centralized engine 120. The centralized engine 120 may be located on-site at an oilfield job location, either on a trailer, independent of a trailer or may be located on a manifold trailer. In some embodiments, the centralized power system 100 may include a plurality of centralized engines 120. The plurality of centralized engines 120 may be redundant to improve reliability. The centralized engine 120 may be any engine capable of supplying power, such as, but not limited to a turbine generator, an AC permanent magnet motor and/or a variable speed motor.

The centralized engine 120 may be sized to power a plurality of equipment at the oilfield job location. In some embodiments, the centralized engine 120 may also include a hydraulic fluid reservoir 121 for supplying hydraulic fluid to a plurality of equipment at the oilfield job location and/or pneumatic equipment 122 for supplying pneumatic fluid to a plurality of equipment at the oilfield job location. The centralized engine 120 may include a central power line 130. The central power line 130 may include a central electricity line, a central hydraulic line and/or a central pneumatic line, each line sized to supply power to a plurality of equipment at the oilfield job location. The central power line 130 may supply electricity, hydraulic fluid and/or pneumatic fluid to a plurality of articulating power connections 125 (illustrated as 125-1 through 125-10) which supply electricity, hydraulic fluid and/or pneumatic fluid to a plurality of equipment 123 (illustrated as 123-1 through 123-10) at the oilfield job location. The plurality of equipment 123 at the oilfield job location may include pumps, turbines, hydraulic fracturing equipment, auxiliary equipment, winterization equipment, liquid transport trailers, sand feeders, and any combination thereof. In other embodiments, the centralized engine 120 may supply electricity, hydraulic fluid and/or pneumatic fluid directly to a plurality of articulating power connections 125 (illustrated as 125-1 through 125-10) which supply electricity, hydraulic fluid and/or pneumatic fluid to a plurality of equipment 123 (illustrated as 123-1 through 123-

10) at the oilfield job location, i.e., without connection through the central power line 130.

To supply power to the plurality of equipment 123, the centralized engine 120 may include a plurality of discharge connectors 135 (illustrated as 135-1 through 135-10). The discharge connector 135 may be located on the central power line 130 (as illustrated) but may also be located directly on the centralized engine 120. The discharge connectors 135 may be coupled to a first end 140 of an articulating power connection 125. A second end 145 of the articulating power connection 125 may be coupled to the equipment 123. The articulating power connection 125 may include electrical, hydraulic, and/or pneumatic lines. In some embodiments, a control system 25 may be used to automate the connection between the centralized engine 120 and the equipment 123 to accurately create an interlock between the centralized engine 120 and the equipment 123 and to insure proper connection and identification between the centralized engine 120 and the equipment 123. In some embodiments, the electrical, hydraulic, and/or pneumatic lines may be located within the articulating power connection 125. In other embodiments, the electrical, hydraulic, and/or pneumatic lines may be located outside the articulating power connection 125, i.e., the articulating power connection 125 provides an exoskeleton to support the lines. The articulating power connections 125 remove rig up lines from the ground. While shown with ten articulating power connections 125-1 through 125-10, a sufficient number of articulating power connections 125 may be connected to the centralized engine 120 to deliver power to the oilfield operation, and may be determined based on a desired volume and pressure output. The number of articulating power connections 125 may vary according to the oilfield service system being supplied power by the centralized engine 120.

Figure 2:
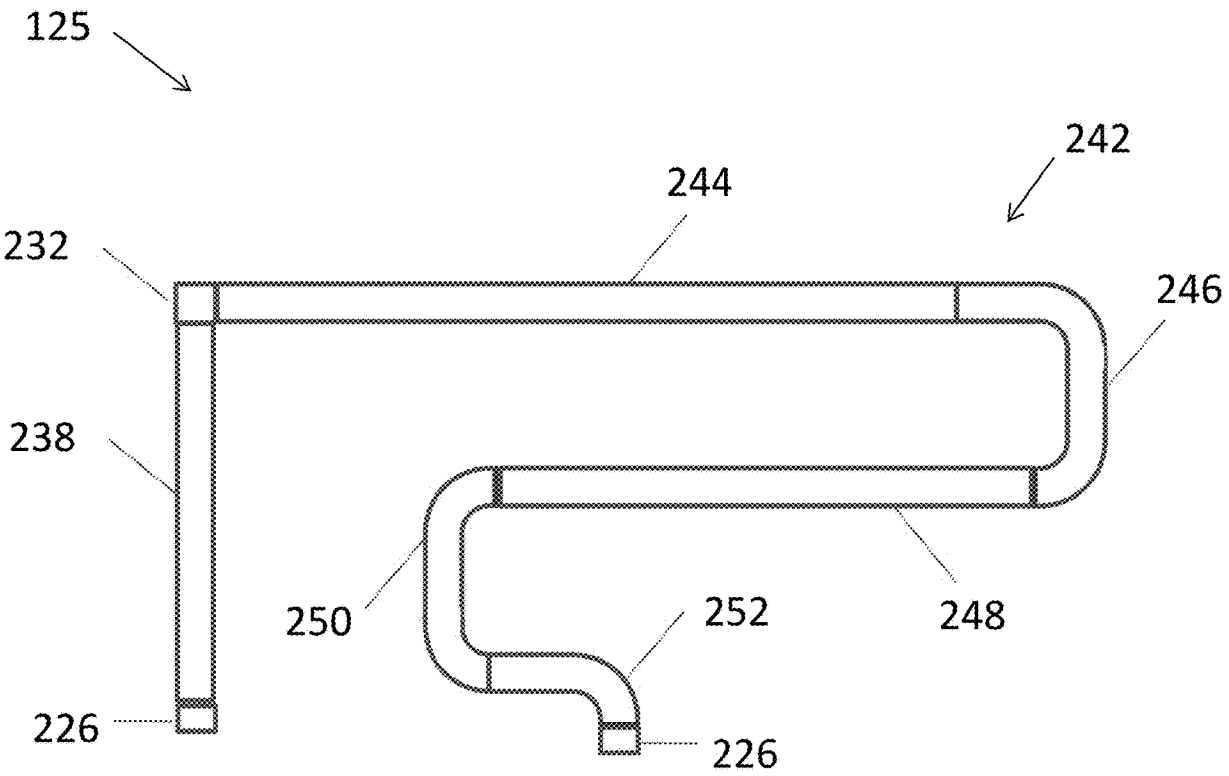
FIG. 2 illustrates a perspective view of an articulating arm assembly, according to an embodiment.

Shown in FIG. 2, an embodiment of an articulating power connection 125 includes a riser swivel 238, the top of which is connected to a connector member 232, and an articulating conduit assembly 242 which is connected to the connector member 232. The conduit assembly includes a generally horizontal inner arm 244 which is connected to the connector member 232, a first swivel joint 246 which is connected to the distal end of the inner arm 244, an outer arm 248 which is connected to the distal end of the first swivel joint 246, a second swivel joint 250 which is connected to the distal end of the outer arm 248, and an end connector 252 which is connected to the distal end of the second swivel joint 250.

The articulating power connection 125, specifically the ends of the central electricity line, the central hydraulic line and/or the central pneumatic line, and the equipment 123 may have plug-and-play connections 226, such as, for example but not limited to, those sold by Parker Hannifin Corp. (Minneapolis, Minn.) or Stucchi USA Inc., Romeoville, Ill. The plug-and-play connections 226 connect the central electricity line, the central hydraulic line and/or the central pneumatic line from the centralized engine 120 to the equipment 123. The plug-and-play connections 226 may be integrated into the articulating power connection 125 and the equipment 123 may be provided with universal terminals so that when plugged into each other, the terminals will make a proper power connection between the central power line 130, including the central electricity line, a central hydraulic line and/or a central pneumatic line, and the equipment 123. A standard socket may be positioned within the articulating power connection 125 to provide a quick no-wiring required connection to the mating terminals on the equipment 123. The plug-and-play connection 226 provides for any articulating power connection 125 to be "plugged" into any type of equipment 123. In some embodiments, each piece of equipment 123 may instruct the control system 25 as to its type and as to its intended use. In operation, the control system 25 would allow the equipment 123, for example, to "announce" what it will supply, i.e., electricity, hydraulic fluid and/or pneumatic fluid, for example a light-switch, or plug, or thermostat, or any other device normally installed and wired as a permanent fixture. In some embodiments, the plug-and-play connection 226 coupled to the riser swivel 238 may be fixedly coupled to the centralized engine 120. In other embodiments, the riser swivel 238 may be fixedly coupled to the centralized engine 120, i.e., without the plug-and-play connection 226.

In some embodiments, the hydraulic line of the articulating power connection 125 also includes a return line. Thus, a hydraulic line loop is formed to provide and recycle hydraulic fluid to the equipment 123. In yet other embodiments, the hydraulic fluid reservoir 121 may be coupled to a cooling system (not shown) to maintain the temperature of the hydraulic fluid to the equipment 123. The cooling system may maintain the temperature of the hydraulic fluid by the control system 25. The level of hydraulic fluid in the hydraulic reservoir 121 should be higher than the top of the first swivel joint 246 to purge air. In some embodiments, the hydraulic line of the articulating power connection 125 can be used for storage of the hydraulic fluid, thus reducing the volume of the hydraulic fluid reservoir 121.

In some embodiments, the centralized engine 120 is sized to supply power for a sequenced oilfield operation. A process diagram of the oilfield operation may be drawn up to determine the power needs during spotting and rig-up, start-up, prime-up, pumping and rig down. Power requirements may be defined to ensure power is provided to perform these functions sequentially. The control system 25 may sequence the operation of the plurality of equipment 123 based on the oilfield operation. Thus, not all equipment is operated at once and the size of the centralized engine 120 can be minimized.

Figure 3:
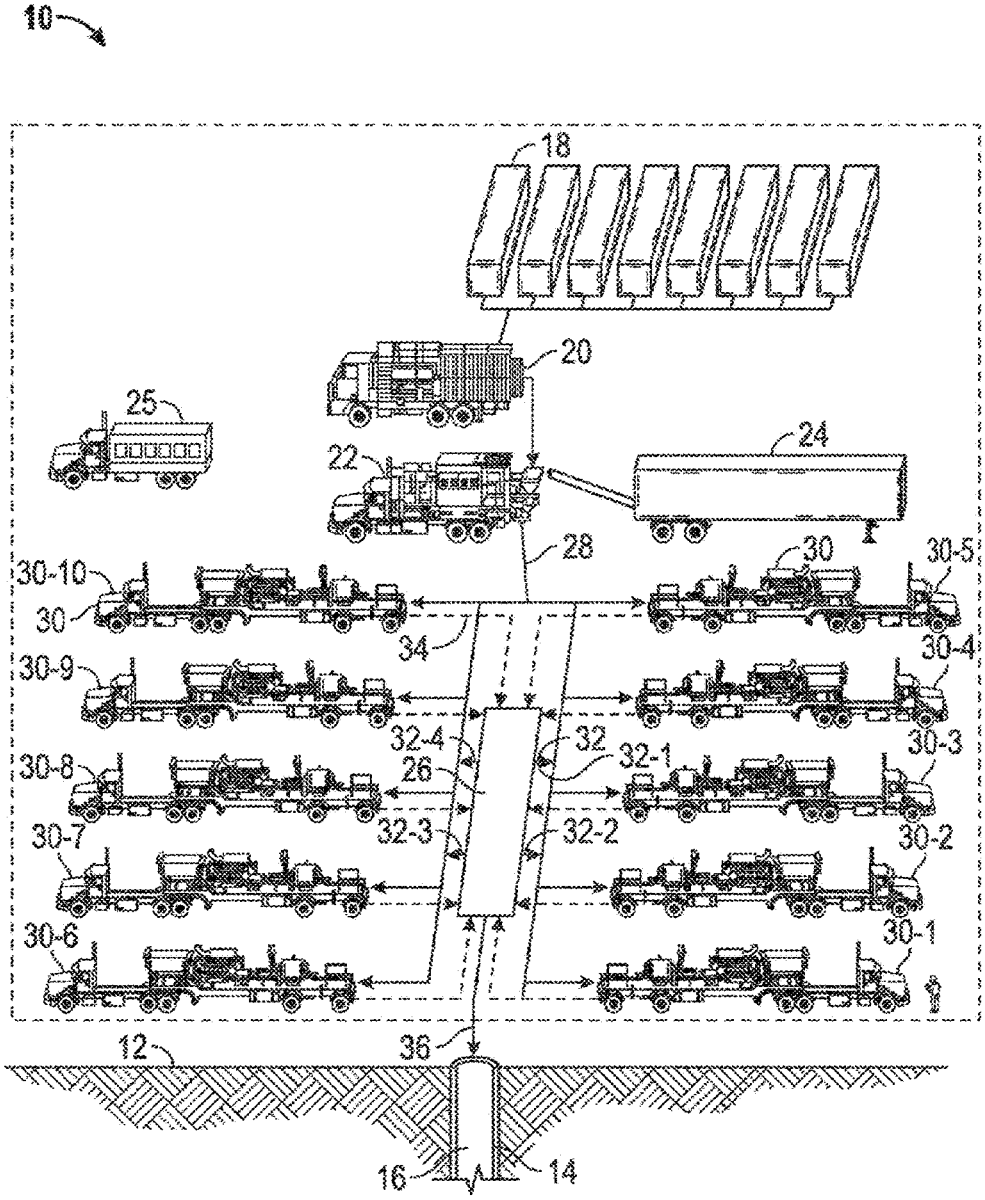
FIG. 3 illustrates a schematic view of an oilfield operation, according to an embodiment.

In some embodiments, the centralized power system 100 may supply power to an oilfield operation, also known as a job. One such exemplary oilfield operation is hydraulic fracturing. The fluid connections for an exemplary hydraulic fracturing operation are shown in FIG. 3. A pump system 10 is shown for pumping a fluid from a surface 12 of a well 14 to a well bore 16 during the oilfield operation. In this particular example, the operation is a hydraulic fracturing operation, and hence the fluid pumped is a fracturing fluid, also called a slurry. As shown, the pump system 10 includes a plurality of water tanks 18, which feeds water to a gel maker 20. The gel maker 20 combines water from the water tanks 18 with a gelling agent to form a gel. The gelling agent increases the viscosity of the fracturing fluid and allows the proppant to be suspended in the fracturing fluid. It may also act as a friction reducing agent to allow higher pump rates with less frictional pressure. The gel is then sent to a blender 22 where it is mixed with a proppant from a proppant feeder 24 to form the fracturing fluid or slurry. The computerized control system 25 may be employed to direct at least a portion of the pump system 10 for the duration of a fracturing operation.

The fracturing fluid is then pumped at low pressure (for example, around 50 to 80 psi) from the blender 22 to a common manifold 26, also referred to herein as a manifold trailer or missile, as shown by solid line 28. The manifold 26 may then distribute the low pressure slurry to a plurality of plunger pumps 30, also called fracturing pumps, or pumps, as shown by solid lines 32. Each fracturing pump 30 receives the fracturing fluid at a low pressure and discharges it to the manifold 26 at a high pressure as shown by dashed lines 34. The manifold 26 then directs the fracturing fluid from the pumps 30 to the well bore 16 as shown by solid line 36. While described with regard to producing a fracturing fluid, the manifold 26 may be any assembly which formulates or produces a wellbore fluid. These wellbore fluids may be, but not limited to, cementing fluids, drilling fluids, etc. Furthermore, the additives are not limited to gellants and proppants, but may include any additive used in the formulation of wellbore fluids.

In some embodiments, the fracturing pumps 30 may be independent units which are plumbed to the manifold trailer 26 at a site of the oilfield operations for each oilfield operation in which they are used. A particular fracturing pump 30 may be connected differently to the manifold trailer 26 on different jobs. The fracturing pumps 30 may be provided in the form of a pump mounted to a standard trailer for ease of transportation by a tractor.

Figure 4:
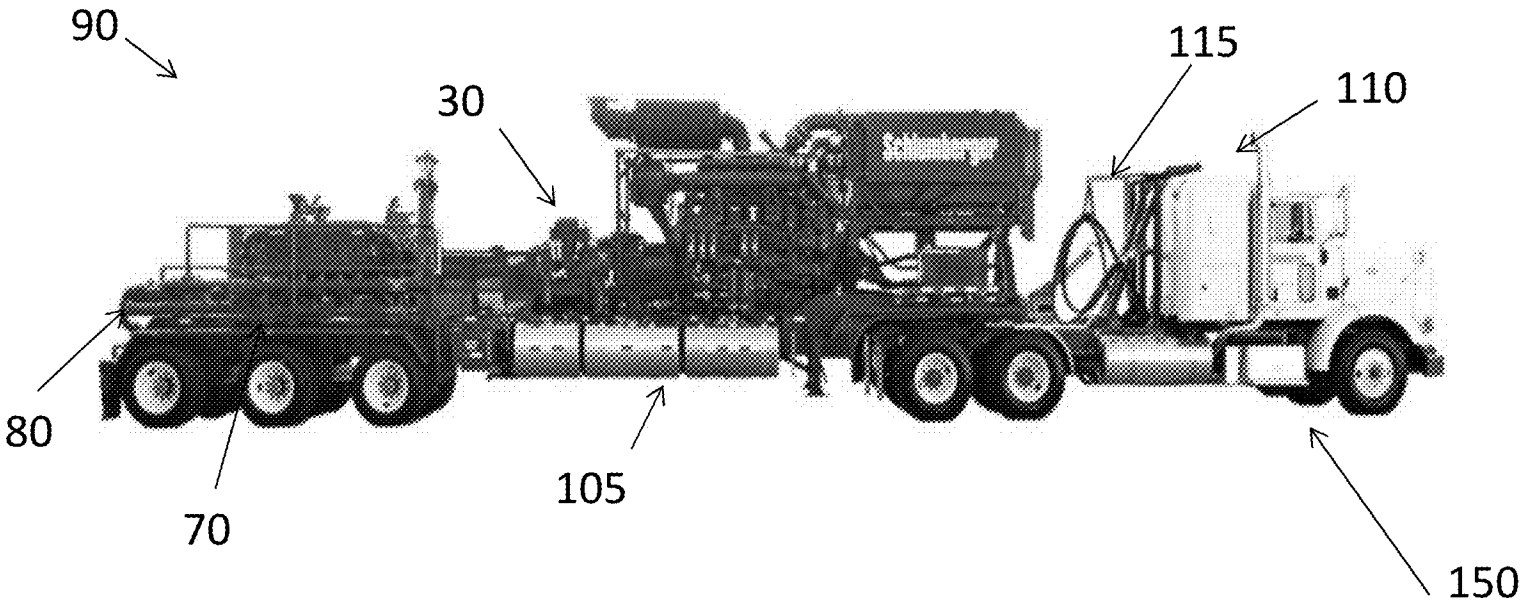
FIG. 4 illustrates a schematic view of a system for transporting well service equipment, according to an embodiment.

For example, referring now to FIG. 4, a fracturing pump 30 is mounted on a trailer 80. The equipment brought to the field location use power. Two main types of power sources are generally present at oilfield service locations: deck engines and tractor engines. As shown in FIG. 4, an integrated transport vehicle 90 is shown. Transport vehicle 90 is illustrated as a semi-truck type vehicle having a tractor 150 designed to pull the trailer 80. The transport vehicle 90 creates a mobile unit that is readily moved from one wellsite to another via the public road system. The trailer 80 may include a platform or skid 70 or other transportable structure on which a variety of systems and components are mounted to facilitate a given well servicing operation. Deck engines 105 may be installed on the skid 70 or trailer 80. Deck engines 105 may be selected to perform wellbore service functions during a job, such as powering fracturing pumps 30 which are designed to deliver pressurized fracturing fluid downhole during operation. Tractor engines 110 are installed on tractors 150 and may be used to haul equipment to a well site. However, aside from their road transportation functions, tractor engines 110 may also be used as a source of power on location at the wellsite. For example, the tractor engine 110 may be used to provide power to start the deck engine 105. The tractor engine 110 is coupled to the deck engine 105 via a plurality of power lines 115. The power lines 115 may supply electrical, pneumatic and/or hydraulic power from the tractor engine 110 to the deck engine 105. Depending on the function of the tractor, the tractor engine may also provide electric, pneumatic or hydraulic power to various equipment on the trailer 80. Most often these functions require very low power and are performed during a very short duration. As an example, about 60 HP from a deck engine may be used to start a 2500 HP fracturing pump. This power may be supplied from a 425 HP tractor engine, for a few minutes only. The tractor engine 110 may be oversized for the purpose of starting the deck engine 105, but is also sized to transport the trailer 80. These tractor engines 110 generate substantial fuel consumption and emissions as well as maintenance cost. Furthermore, because each tractor engine 110 may be dedicated to the trailer 80, there is an additional cost of leasing multiple trailers.

Each trailer 80 is an independent unit and may include one or more wellbore service type equipment, for example fracturing pumps 30, plumbed to the manifold trailer 26 at a job site of a fracturing operation and may be powered by an independent deck engine 110. A sufficient number of trailers 80 and equipment may be connected to the manifold trailer 26 to produce a desired volume and pressure output. For example, some fracturing jobs have up to 36 pumps, each of which may be connected to the manifold 26 and to the deck engine 110.

As mentioned, the fracturing pumps 30 utilize power, and may receive power from the deck engine 105. However, in accordance with embodiments of the present disclosure, the startup of the deck engine 105 may be shifted from the tractor engine 110 to a centralized power system, which may minimize the fuel consumption, emissions and maintenance costs for the oilfield operations. The central power system may also be sized for the function of starting the deck engine 105.

Figure 5:
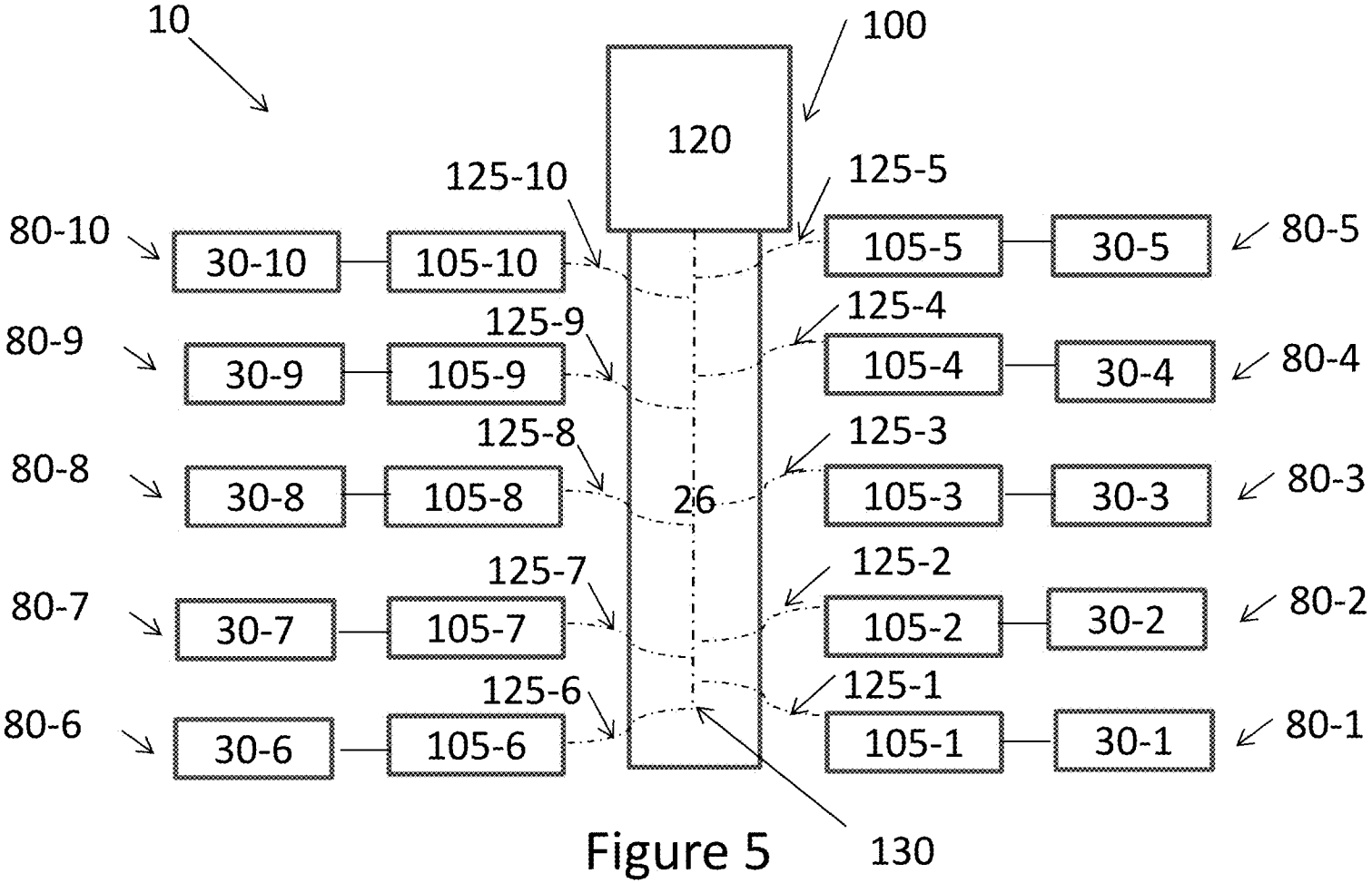
FIG. 5 illustrates a block diagram of a manifold trailer, according to an embodiment.
Figure 6:
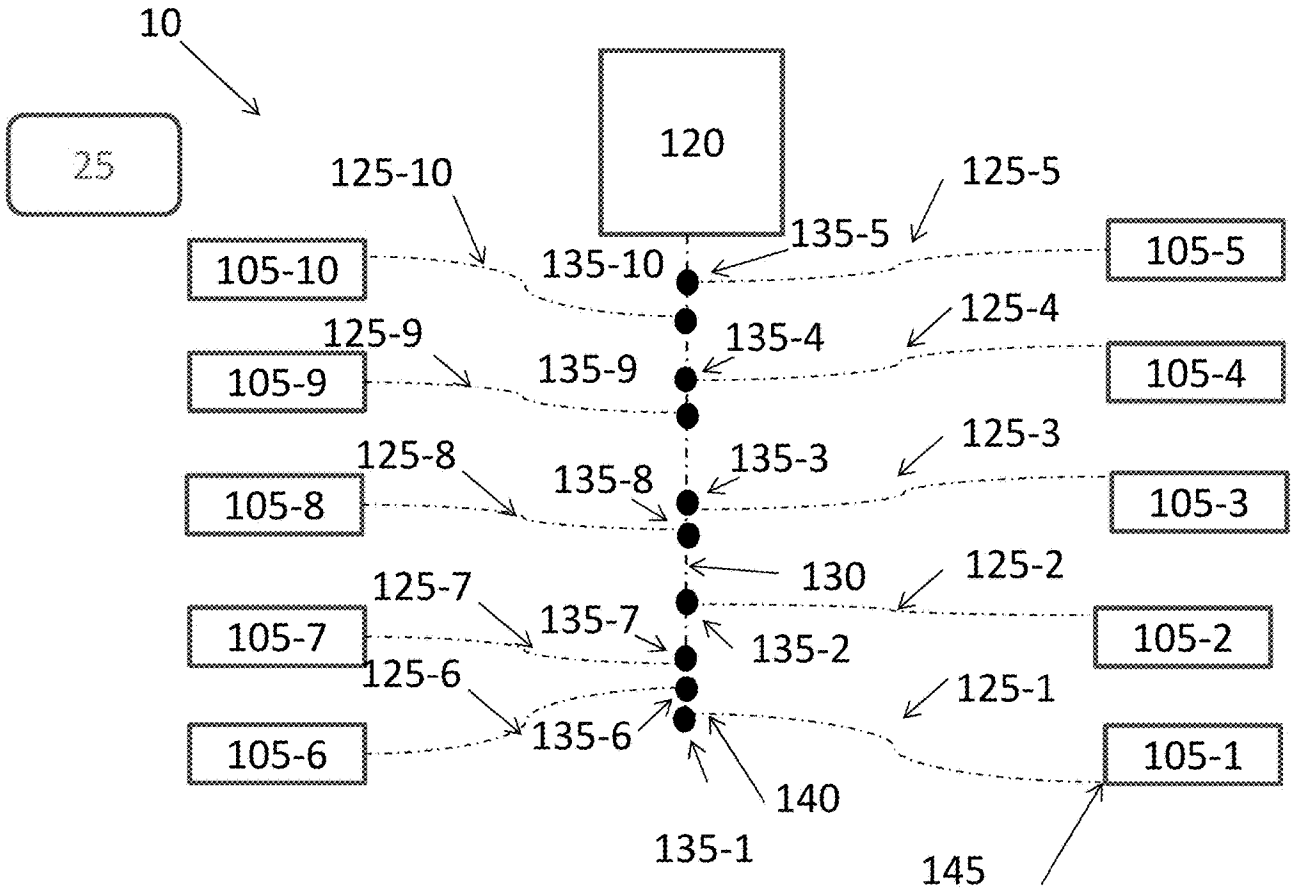
FIG. 6 illustrates a block diagram of a centralized power system in an oilfield operation, according to an embodiment.

Shown in FIGS. 5 and 6 are embodiments of the pump system 10, utilizing the centralized power system 100 of the present disclosure. FIG. 5 illustrates the connections between a plurality of trailers 80 (illustrated as 80-1 through 80-10) and the centralized power system 100 while FIG. 6 details the connections of the articulating power connections 125. As shown in FIG. 5, the centralized engine 120 may be installed on the manifold trailer 26. However, in some embodiments, the centralized engine 120 may be located on a separate trailer or may be independent of a trailer. The centralized engine 120 may be sized to power the plurality of deck engines 105. The central power line 130 supplies power to a plurality of articulating power connections 125 (illustrated as 125-1 through 125-10) which supplies power to a plurality of deck engines 105 (illustrated as 105-1 through 105-10) located on a plurality of trailers. In some embodiments, the plurality of articulating power connections 125 may be separate from the articulating arms that deliver fluid. In other embodiments, the plurality of articulating power connections 125 may be coupled to the articulating arms that deliver fluid. Thus, the centralized engine 120 is on the manifold trailer 26 or other location that is distinct from the trailer 80 on which the deck engines 105 are located. Deck engines 105 may start and/or supply power to a variety of service equipment having a range of power requirements, such as, but not limited to, fracturing pumps 30 (illustrated as 30-1 through 30-10).

The size of the centralized engine 120 may be optimized by mapping the power usage for the oilfield operation. For example, for operating fracturing pumps 30 during a fracturing operation, Table 1 shows an exemplary equipment power breakdown between the deck engine 105 and the centralized engine 120.

TABLE 1

Equipment Power Breakdown for Fracturing Pump

| Equipment type | Source | Usage | Power category | Power required |
|---|---|---|---|---|
| Fracturing Pump 30 | Deck engine 105 | Pump operation | Mechanical | 1500-2200 hp |
| | | Engine accessories | Mechanical | 200 hp |
| | Centralized engine 120 | Deck engine startup | Hydraulic | 70 hp |
| | | Engine accessories | Mechanical | 45 hp |

Another factor for determining the size of the centralized engine 120 may be the job sequence. For example, in a fracturing job, during spotting/rig up and start up, the centralized engine 120 is utilized. During prime up and pumping, the deck engine 105 is utilized. One of ordinary skill in the art would map the job sequence and the power breakdown to determine the appropriate size of the centralized engine 120. In some embodiments, the centralized engine 120 is sized to start a single deck engine 105.

In some embodiments, the centralized engine 120 supplies power to the deck engine 105 in a range from about 40 hp to about 300 hp. However, the size of the centralized engine 120 will be dependent on the number/size of equipment being supplied, along with sequencing operations for the job, as known to one of ordinary skill in the art. In some embodiments, the centralized engine 120 may be a single engine. In other embodiments, the centralized engine 120 may be two engines, such as one engine having a backup engine. If the centralized engine 120 is a plurality of engines, a variety of engines for supplying a variety of power requirements may be used, such as a first power engine supplying a first power amount, a second power engine supplying a second power amount, and a third power engine supplying a third power amount. The first, second and third power engines may be sized to supply a variety of power amounts. These first, second, and third power engines may also include backup engines to increase the reliability of the centralized engine 120. The centralized engine 120 may be operated at about 80 percent utilization. In some embodiments, the centralized engine 120 may be operated at a percent utilization ranging from about 50 to about 80 percent utilization or from about 60 to about 70 percent utilization. However, as known to one skilled in the art, the centralized engine 120 may be operated at any percent utilization as determined for the oilfield operation.

To supply power to the deck engines 105, the centralized engine 120 may include a plurality of discharge connectors 135 (illustrated as 135-1 through 135-10), shown in FIG. 6. The discharge connectors 135 may be coupled to a first end 140 of an articulating power connection 125. A second end 145 of the articulating power connection 125 may be coupled to the deck engine 105. The articulating power connection 125 may include hydraulic, pneumatic and/or electrical lines. Programs within the computerized control system 25 may be used to automate the connection between the centralized engine 120 and the deck engine 105 to accurately to create an interlock between the centralized engine 120 and the deck engine 105 and to insure proper connection and identification between the engines.

The articulating power connections 125 remove rig up lines from the ground. While shown with ten articulating power connections 125-1 through 125-10, a sufficient number of articulating power connections 125 may be connected to the centralized engine 120 to deliver power to the pump system 10 which is sized to deliver a desired volume and pressure output. The number of articulating power connections 125 may vary according to the oilfield service system being supplied power by the centralized engine 120. With the centralized engine 120 providing power to the deck engine 105, the tractor engine 110 may be utlilized for transportation purposes. As such, the transport vehicle 90, including the tractor engine 110 may become a shared asset between multiple trailers 80 having multiple pieces of equipment and may be located at multiple locations. In some embodiments, the centralized engine 120 may have a dedicated trailer which may be moved to multiple oilfield locations on semi-trailer trucks or the like.

Each fracturing pump 30 may be coupled to a corresponding deck engine 105. The deck engine 105 supplies power to the fracturing pump 30. The power may be electric, pneumatic or hydraulic depending on the stage of the fracturing job, i.e., rig-up, start-up, prime-up, pumping and rig down.

Figure 7:
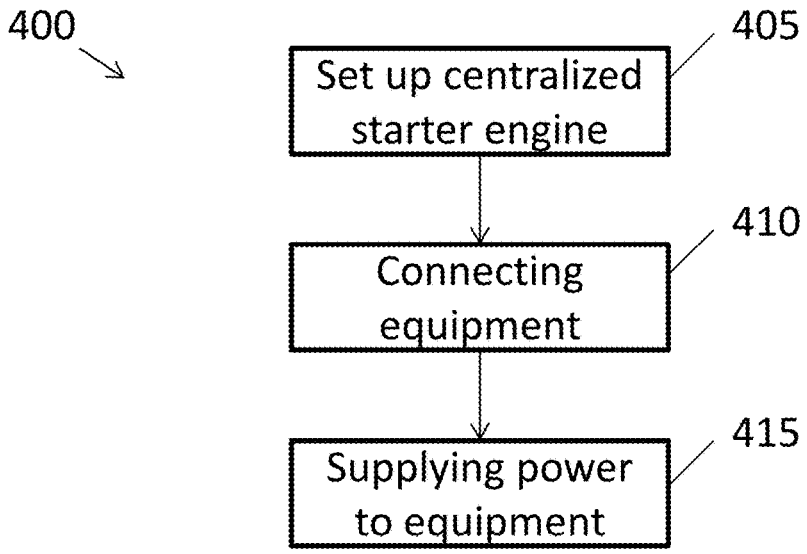
FIG. 7 illustrates a block diagram of a method for supplying power to equipment in an oilfield operation, according to an embodiment.

FIG. 7 illustrates an exemplary method 400 of utilizing the centralized engine 120 to power the plurality of equipment 123 at an oilfield location. The centralized engine 120 is set up at 405. The set up may include transporting the centralized engine 120 to the oilfield location. As described above, the centralized engine 120 may be on a transportable manifold trailer 26. By placing the centralized engine 120 on the manifold trailer 26, the footprint of the oilfield location may be minimized.

The centralized engine 120 is then connected to the plurality of equipment 123 through the articulating power connections 125 at 410. The articulating power connections 125 may minimize the rig up time. The centralized engine 120 supplies power to the equipment at 415. The equipment 123 which may utilize power from the centralized engine 120 includes, but is not limited to, pumps, blenders, valves, and cranes. The equipment 123 may be located on the trailer 80 or at the wellsite.

In some embodiments, the computerized control system 25 may be used to automate and manage the connection between the centralized engine 120 and the plurality of equipment 123. The computerized control system 25 may be programmed to identify the articulating power connections 125 connected between the centralized engine 120 and the plurality of equipment 123. The computerized control system 25 may be programmed to identify the plurality of equipment 123.

The computerized control system 25 may provide instruction to the centralized engine 120 to supply power to the plurality of equipment 123 via the articulating power connection 125. In some embodiments, the computerized control system 25 may provide instruction to the centralized engine 120 to supply power to the plurality of equipment 123 sequentially via the articulating power connection 125. By sequentially starting the equipment 123, the power requirement of the centralized engine 120 may be minimized. In some embodiments, the computerized control system 25 may provide instruction to the centralized engine 120 to supply power to the plurality of equipment 123 simultaneously via the articulating power connection 125. In some embodiments, the computerized control system 25 may provide instruction to the centralized engine 120 to supply electrical power to the plurality of equipment 123 via the articulating power connection 125 and then supply hydraulic and/or pneumatic power to the plurality of equipment 123. The hydraulic and/or pneumatic power may be supplied sequentially or simultaneously to the plurality of equipment 123. In some embodiments, the computerized control system 25 may not be used and the operation is performed manually.

Figure 8:
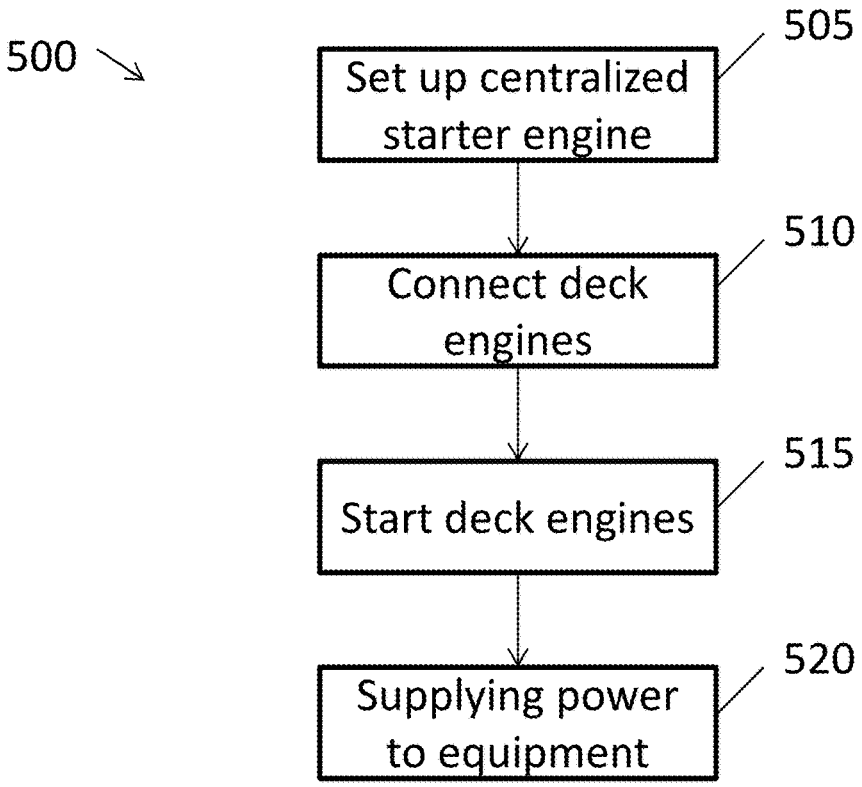
FIG. 8 illustrates a block diagram of a method for starting fracturing equipment in an oilfield operation, according to an embodiment.

FIG. 8 illustrates an exemplary method 500 of utilizing the centralized engine 120 to start the plurality of deck engines 105 at a fracturing job oilfield location. The centralized engine 120 is set up at 505. The set up may include transporting the centralized engine 120 to the oilfield location. As described above, the centralized engine 120 may be on a transportable manifold trailer 26. By placing the centralized engine 120 on the manifold trailer 26, the footprint of the oilfield location may be minimized.

The centralized engine 120 is then connected to the plurality of deck engines 105 through the articulating power connections 125 at 510. The articulating power connections 125 may minimize the rig up time. The centralized engine 120 may start up the deck engines at 515. In some embodiments, the deck engine 105 may be used to supply power to one or more pieces of equipment at 520. The equipment which may utilize power from the deck engine 105 includes, but is not limited to, fracturing pumps and blenders. The equipment may be located on the trailer 80 or at the wellsite. In some embodiments, the centralized engine 120 may supply power to one or more pieces of equipment at 520. In some embodiments, the centralized engine 120 may start up the deck engines 105 and supply power to one or more pieces of equipment at 515, simultaneously. In other embodiments, the centralized engine 120 may supply power to one or more pieces of equipment at 515 instead of the deck engine.

In some embodiments, the computerized control system 25 may be used to automate and manage the connection between the centralized engine 120 and the deck engines 105. The computerized control system 25 may be programmed to identify the articulating power connections 125 connected between the centralized engine 120 and the deck engines 105. The computerized control system 25 may be programmed to identify the deck engines 105 connected to corresponding fracturing pumps 30. The computerized control system 25 may also ensure the deck engines 105 are connected to corresponding fracturing pumps 30.

The computerized control system 25 may provide instruction to the centralized engine 120 to supply power to the deck engine 105 via the articulating power connection 125. In some embodiments, the computerized control system 25 may provide instruction to the centralized engine 120 to supply power to the deck engines 105 sequentially via the articulating power connection 125. By sequentially starting the deck engines 105, the power requirement of the centralized engine 120 may be minimized.

While the present teachings have been illustrated with respect to one or more embodiments, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A centralized power system comprising:

at least one engine having a plurality of discharge connectors; and a plurality of articulating power connectors, each articulating power connector comprising a first end connected to a corresponding discharge connector, and a second end connectable to at least one piece of oilfield equipment thereby supplying power from the at least one engine to the oilfield equipment.

2. The system of claim 1, wherein the centralized power system is located on a central manifold.

3. The system of claim 2, wherein the central manifold is transportable on a truck.

4. The system of claim 1, wherein the at least one engine supplies power ranging from about 40 hp to about 300 hp.

5. The system of claim 1, wherein the at least one engine operates at least about 80 percent utilization.

6. The system of claim 1, wherein the at least one engine comprises at least two engines for supplying power, each engine supplying power at a different power rating.

7. The system of claim 1, further comprising a control system for managing a starting sequence of each piece of oilfield equipment receiving power from the articulating power connectors.

8. The system of claim 1, wherein the plurality of articulating power connectors comprises electrical lines for supplying electricity to the at least one piece of oilfield equipment.

9. The system of claim 1, further comprising a hydraulic reservoir for supplying hydraulic fluid to the at least one piece of oilfield equipment.

10. The system of claim 9, wherein the plurality of articulating power connectors comprises a feed hydraulic line and a return hydraulic line for supplying hydraulic fluid from the hydraulic reservoir to and from the at least one piece of oilfield equipment.

11. The system of claim 9, further comprising a cooling system to cool the hydraulic fluid reservoir.

12. The system of claim 1, further comprising pneumatic equipment for supplying pneumatic fluid to the at least one piece of oilfield equipment.

13. The system of claim 12, wherein the plurality of articulating power connectors comprises a pneumatic line for supplying pneumatic fluid to the at least one piece of oilfield equipment.

14. The system of claim 1, wherein the centralized power system is transportable on a truck.

15. A method of starting at least one piece of wellbore fluid service equipment, the method comprising:

coupling a centralized power engine for supplying power to a plurality of equipment via a plurality of articulating arms; and supplying power to the plurality of equipment from the centralized power engine.

16. The method of claim 15, wherein the supplying power is performed by a computer program.

17. The method of claim 15, further comprising setting up the centralized power engine at an oilfield location.

18. The method of claim 17, wherein the setting up comprises transporting the centralized power engine to an oilfield location.

19. The method of claim 15, wherein the plurality of equipment comprises at least one deck engine.

20. The method of claim 15 wherein the centralized power engine is disposed on a manifold trailer.

* * * * *